US011421635B2

(12) United States Patent
Nabeshima et al.

(10) Patent No.: US 11,421,635 B2
(45) Date of Patent: Aug. 23, 2022

(54) ELECTROMAGNETIC FUEL INJECTION VALVE

(71) Applicant: KEIHIN CORPORATION, Tokyo (JP)

(72) Inventors: Yasuhiko Nabeshima, Tochigi (JP); Kento Yoshida, Tochigi (JP); Nozomu Sasaki, Tochigi (JP); Shou Kanda, Tochigi (JP)

(73) Assignee: Hitachi Astemo, Ltd., Ibaraki (JP)

( * ) Notice: Subject to any disclaimer, the term of this patent is extended or adjusted under 35 U.S.C. 154(b) by 0 days.

(21) Appl. No.: 17/023,859

(22) Filed: Sep. 17, 2020

(65) Prior Publication Data

US 2021/0088015 A1 Mar. 25, 2021

(30) Foreign Application Priority Data

Sep. 20, 2019 (JP) ..... JP2019-171264

(51) Int. Cl.
*F02M 61/20* (2006.01)
*F02M 51/06* (2006.01)
*F02M 61/18* (2006.01)

(52) U.S. Cl.
CPC ..... *F02M 51/061* (2013.01); *F02M 61/1886* (2013.01); *F02M 61/20* (2013.01)

(58) Field of Classification Search
CPC .. F02M 51/061; F02M 61/1886; F02M 61/20; F02M 51/0685; F02M 51/0671
See application file for complete search history.

(56) References Cited

U.S. PATENT DOCUMENTS 5,732,888 A * 3/1998 Maier ..... F02M 51/0664 251/129.21
5,996,911 A * 12/1999 Gesk ..... F02M 61/168 251/129.21

(Continued)

FOREIGN PATENT DOCUMENTS

JP 2006-307870 A 11/2006
JP 2017-008945 A 1/2017

(Continued)

OTHER PUBLICATIONS

Official Communication dated Jun. 24, 2020 issued over the corresponding Japanese Patent Application No. 2019-171264.

*Primary Examiner* — Joseph A Greenlund
(74) *Attorney, Agent, or Firm* — Carrier Blackman & Associates, P.C.; William D. Blackman; Joseph P. Carrier

(57) ABSTRACT

An electromagnetic fuel injection valve includes: a valve body having a rod connected to a valve part; a movable core fitted onto the rod slidably between valve-open side and valve-closed side stoppers; a fixed core having an attracting face opposing the movable core; a valve spring urging the valve body in a valve-closing direction; and an auxiliary spring exhibiting a spring force that urges the movable core to separate from the valve-open side stopper and abut against the valve-closed side stopper when a coil is unenergized. A first curved face part is protruded from a surface, opposing the movable core, of the fixed core, and a second curved face part is provided in an outer peripheral part of a surface, opposing the movable core, of the valve-open side stopper, the first and second curved face parts each having an arcuate cross-section and being capable of abutting against the movable core.

1 Claim, 5 Drawing Sheets

(56) References Cited

U.S. PATENT DOCUMENTS

| | | | | |
|---|---|---|---|---|
| 7,051,960 | B2 * | 5/2006 | Oguma | F02M 51/0671 239/585.4 |
| 7,086,614 | B2 * | 8/2006 | Stier | F02M 61/205 239/585.5 |
| 7,278,594 | B2 * | 10/2007 | Koyanagi | F02M 51/0657 239/585.4 |
| 7,458,531 | B2 * | 12/2008 | Mochizuki | F02M 51/061 251/129.21 |
| 8,104,698 | B2 * | 1/2012 | Hayatani | F02M 51/0685 239/533.14 |
| 8,430,343 | B2 * | 4/2013 | Nagatomo | F02M 51/0685 123/472 |
| 8,991,783 | B2 * | 3/2015 | Abe | F02M 51/0653 239/533.9 |
| 9,702,475 | B2 * | 7/2017 | Scheffel | F02M 51/0614 |
| 10,006,428 | B2 * | 6/2018 | Yasuda | F02M 63/0075 |
| 10,883,461 | B2 * | 1/2021 | Yamazaki | F02M 51/0628 |
| 2007/0194151 | A1 * | 8/2007 | Hayatani | F02M 51/0685 239/585.1 |
| 2012/0204839 | A1 * | 8/2012 | Ohwada | F02M 51/0614 123/472 |
| 2017/0074222 | A1 * | 3/2017 | Takaoku | F16K 1/12 |
| 2017/0145974 | A1 * | 5/2017 | Yasuda | F02M 61/20 |
| 2019/0078543 | A1 * | 3/2019 | Yamazaki | F16K 31/0655 |
| 2021/0062771 | A1 * | 3/2021 | Singh | F16K 31/0689 |
| 2021/0088015 | A1 * | 3/2021 | Nabeshima | F02M 51/061 |
| 2021/0246858 | A1 * | 8/2021 | Nabeshima | F02M 51/0685 |

FOREIGN PATENT DOCUMENTS

| | | | |
|---|---|---|---|
| JP | 2017-096131 | A | 6/2017 |
| WO | 2008/038395 | A1 | 4/2008 |
| WO | 2018/083795 | A1 | 5/2018 |

* cited by examiner

VALVE-OPEN STATE

ELECTROMAGNETIC FUEL INJECTION VALVE

CROSS REFERENCE TO RELATED APPLICATIONS

The present application claims priority under 35 U.S.C. § 119 to Japanese Patent Application No. 2019-171264 filed Sep. 20, 2019 the entire contents of which are hereby incorporated by reference.

BACKGROUND OF THE INVENTION

Field of the Invention

The present invention relates to an electromagnetic fuel injection valve, particularly an electromagnetic fuel injection valve comprising a valve housing that has a valve seat in one end part thereof, a hollow fixed core that is connected to an other end of the valve housing, a coil that is disposed on an outer periphery of the fixed core, a valve body that is formed by having a rod connected to a valve part that operates in cooperation with the valve seat, a movable core that is slidably fitted onto the rod while opposing an attracting face of the fixed core, a valve-open side stopper that is fixed to the rod and, by abutting against the movable core, that is attracted to the attracting face when the coil is energized, causes the valve body to undergo a valve-opening operation, a valve-closed side stopper that is fixed to the rod further on the valve seat side than the valve-open side stopper, a valve spring that urges the valve body in a valve-closing direction, and an auxiliary spring that exhibits a spring force that urges the movable core to move away from the valve-open side stopper and abut against the valve-closed side stopper when the coil is unenergized.

DESCRIPTION OF THE RELATED ART

Such an electromagnetic fuel injection valve is known in Japanese Patent Application Laid-open No. 2017-96131.

In such an electromagnetic fuel injection valve, when the valve opens, it is only the movable core that slides on the rod of the valve body and is attracted toward the fixed core side; after being accelerated, the movable core pushes upward the valve-open side stopper fixed to the rod against a set load of the valve spring, thus enabling the valve body to be opened promptly, and valve-opening responsiveness of the valve body can be enhanced. Furthermore, when the valve closes, the movable core urged by means of the auxiliary spring abuts against the valve-closed side stopper, and therefore it is possible to minimize an amount of rearward rebound of the valve body due to a seating impact when the valve body is seated on the valve seat for the first time.

In order to improve combustion efficiency of an internal combustion engine, it is required [1] to control opening and closing of the fuel injection valve with higher accuracy and [2] to increase pressure of fuel.

Moreover, in order to especially respond to the requirement of [1], that is, controlling of the fuel injection valve with high accuracy, it is necessary to further improve responsiveness of the fuel injection valve. In addition, for the requirement of [2], that is, in order to increase a pressure of fuel, it is necessary to increase an electromagnetic attraction force with respect to the valve body, but in that case, it is assumed that a collision force to the valve-open side stopper of the movable core will be increased in accordance with the increase of the electromagnetic attraction force, thus requiring measures against wear of the movable core.

SUMMARY OF THE INVENTION

The present invention has been accomplished in light of such circumstances, and it is an object thereof to provide an electromagnetic fuel injection valve that can improve combustion efficiency of an internal combustion engine by enhancing responsiveness of a fuel injection valve, particularly, valve-closing responsiveness thereof, and also can reduce wear of a movable core and prevent damage thereof by reducing a collision force to a valve-open side stopper.

In order to achieve the object, according to a first aspect of the present invention, there is provided an electromagnetic fuel injection valve comprising a valve housing that has a valve seat in one end part thereof, a hollow fixed core that is connected to an other end of the valve housing, a coil that is disposed on an outer periphery of the fixed core, a valve body that is formed by having a rod connected to a valve part that operates in cooperation with the valve seat, a movable core that is slidably fitted onto the rod while opposing an attracting face of the fixed core, a valve-open side stopper that is fixed to the rod and, by abutting against the movable core, that is attracted to the attracting face when the coil is energized, causes the valve body to undergo a valve-opening operation, a valve-closed side stopper that is fixed to the rod further on the valve seat side than the valve-open side stopper, a valve spring that urges the valve body in a valve-closing direction, and an auxiliary spring that exhibits a spring force that urges the movable core to move away from the valve-open side stopper and abut against the valve-closed side stopper when the coil is unenergized, wherein a first curved face part is protruded from a surface, opposing the movable core, of the fixed core, the first curved face part having an arcuate cross-section and being capable of abutting against the movable core, and a second curved face part is provided in an outer peripheral part of a surface, opposing the movable core, of the valve-open side stopper, the second curved face part having an arcuate cross-section and being capable of abutting against the movable core.

In accordance with the first aspect of the present invention, the first curved face part is protruded from the surface, opposing the movable core, of the fixed core, the first curved face part having the arcuate cross-section and being capable of abutting against the movable core. Therefore, in a valve-open state, the surface, opposing the fixed core, of the movable core abuts locally against the fixed core at the first curved face part, that is, the entire opposing surfaces of the movable core and the fixed core are not in an abutment state, and it is thus possible to effectively reduce an influence of residual magnetism on the movable core in a valve-closing process. Accordingly, since the movable core smoothly moves away from the fixed core, it is possible to contribute to improving valve-closing responsiveness, and consequently, enhancing combustion efficiency of an internal combustion engine. Moreover, the second curved face part is provided in the outer peripheral part of the surface, opposing the movable core, of the valve-open side stopper, the second curved face part having the arcuate cross-section and being capable of abutting against the movable core. Therefore, in a valve-opening process, even if the movable core slides on the rod while inclining more or less due to a sliding clearance between the movable core and the rod and then collides with the valve-open side stopper, the collision portion with which the movable core collides is the second curved face part in the outer peripheral part of the valve-open side stopper, and therefore, it is possible to effectively prevent early wear and damage of the movable core due to the collision load being concentrated on one point of the valve-open side stopper. Accordingly, even if an attracting force to the movable core is increased in order to increase a pressure of fuel, it is possible to contribute to improving durability of the movable core.

According to a second aspect of the present invention, in addition to the first aspect, a surface, opposing the fixed core, of the movable core is formed as a taper face having a diameter thereof increased in going away from the fixed core, and a surface, opposing the valve-open side stopper, of the movable core is formed as a flat face orthogonal to an axis of the rod.

In accordance with the second aspect of the present invention, the surface, opposing the fixed core, of the movable core is formed as the taper face having the diameter thereof increased in going away from the fixed core. Therefore, when in the valve-opening process, the movable core slides on the rod while inclining more or less due to the sliding clearance and then abuts against the fixed core, the taper face of the movable core abuts against a portion, relatively close to an inner side (that is, the rod side), of the first curved face part of the fixed core. Accordingly, since it is possible to make relatively small a swing amount of the movable core with said abutment portion as a swing fulcrum, swing of the movable core is apt to easily stop, thereby enabling contribution to improvement of valve-opening responsiveness. Moreover, although the surface, opposing the fixed core, of the movable core is formed as the taper face as described above, a middle portion (that is, the surface opposing the valve-open side stopper) of the movable core is formed as a flat face orthogonal to the axis of the rod. Therefore, when the movable core slides on the rod while inclining more or less due to the sliding clearance and then collides with the valve-open side stopper, finally the flat face of the movable core butts against the valve-open side stopper, and thus, it is possible to avoid a collision force acting locally on a part (for example, an edge-shaped tapered portion) of the taper face to thus effectively prevent wear and damage of the movable core.

The above and other objects, characteristics and advantages of the present invention will be clear from detailed descriptions of the preferred embodiments which will be provided below while referring to the attached drawings.

DESCRIPTION OF THE PREFERRED EMBODIMENTS

Figure 1:
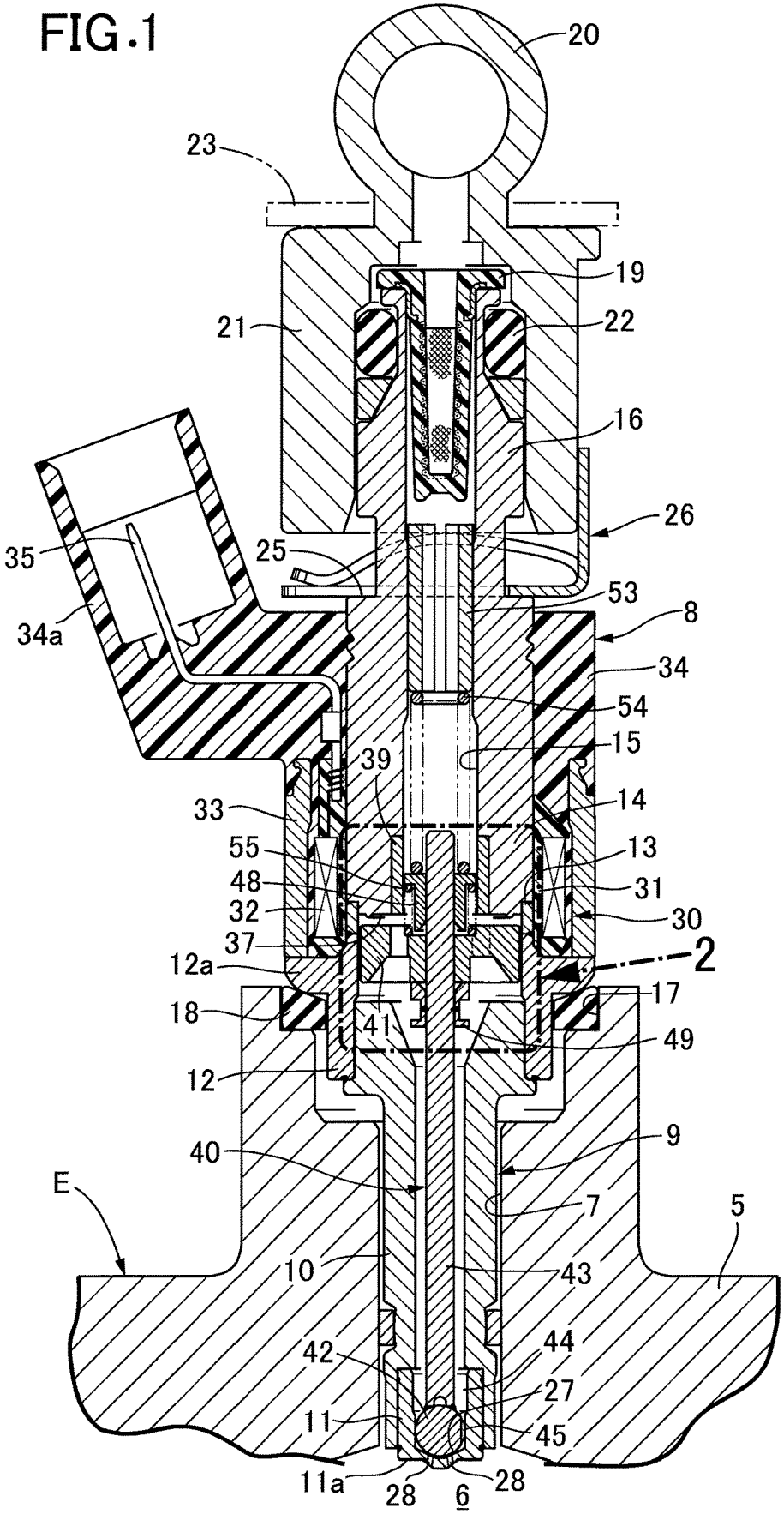
FIG. 1 is a longitudinal sectional view showing a first embodiment of an electromagnetic fuel injection valve for an internal combustion engine according to the present invention.
Figure 2:
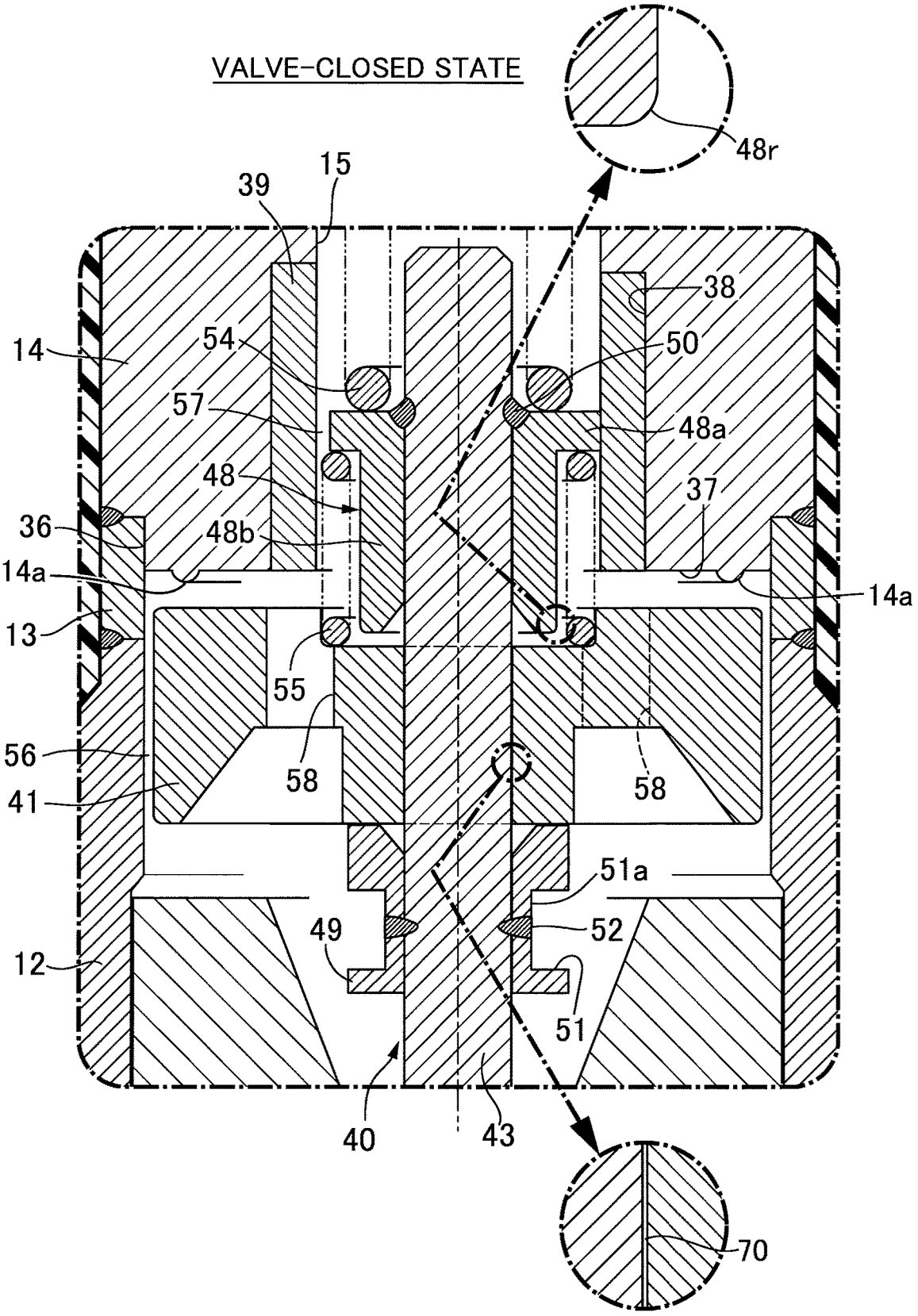
FIG. 2 is an enlarged sectional view of a part indicated by arrow 2 in FIG. 1, which shows a valve-closed state of the fuel injection valve.

A first embodiment of the present invention is explained by reference to the attached FIG. 1 to FIG. 3. First, in FIG. 1 and FIG. 2, a cylinder head 5 of an internal combustion engine E is provided with a fitting hole 7 opening in a combustion chamber 6, and an electromagnetic fuel injection valve 8 that can inject fuel toward the combustion chamber 6 is fitted into the fitting hole 7.

A valve housing 9 of the electromagnetic fuel injection valve 8 is formed from a hollow cylindrical housing body 10, a valve seat member 11 fitted into and welded to the inner periphery of one end part of the housing body 10, a magnetic cylindrical body 12 having one end part thereof fitted onto the outer periphery of the other end part of the housing body 10 and welded to the housing body 10, and a non-magnetic cylindrical body 13 having one end part thereof coaxially joined to the other end part of the magnetic cylindrical body 12. One end part of a fixed core 14 having a hollow part 15 is coaxially joined to the other end part of the non-magnetic cylindrical body 13, and a fuel supply tube 16 communicating with the hollow part 15 is coaxially and integrally connected to the other end part of the fixed core 14.

The magnetic cylindrical body 12 integrally has a flange-shaped yoke portion 12*a* in an intermediate part in the axial direction thereof, and a cushion material 18 housed in an annular recess 17 provided in the cylinder head 5 so as to surround the outer end of the fitting hole 7 is disposed between the cylinder head 5 and the yoke portion 12*a*.

A fuel filter 19 is fitted into the other end part, that is, an inlet, of the fuel supply tube 16, and the fuel supply tube 16 is fitted, via an annular seal member 22, with a fuel supply cap 21 provided on a fuel distribution pipe 20. A bracket 23 is engaged with a top part of the fuel supply cap 21 and removably fastened by an appropriate fixing means (for example, a bolt) to a support post, which is not illustrated, standingly provided on the cylinder head 5.

An elastic member 26, which is formed from a plate spring, is disposed between the fuel supply cap 21 and an annular step part 25 provided on an intermediate part of the fuel supply tube 16 and facing the fuel supply cap 21 side. The fuel supply tube 16, that is, the electromagnetic fuel injection valve 8, is clamped between the cylinder head 5 and the elastic member 26 by means of the resilient force exhibited by this elastic member 26.

The valve seat member 11 is formed into a bottomed cylindrical shape having an end wall portion 11*a* on one end part of the valve seat member 11, a conical valve seat 27 is formed on the end wall portion 11*a*, and a plurality of fuel discharge holes 28 are provided so as to open in the vicinity of the center of the valve seat 27. This valve seat member 11 is fitted into and welded to one end part of the housing body 10 so that the fuel discharge holes 28 open toward the combustion chamber 6. That is, the valve housing 9 is formed so as to have the valve seat 27 on one end part of the valve housing 9.

A coil assembly 30 is fitted onto an outer peripheral face from the other end part of the magnetic cylindrical body 12 to the fixed core 14. This coil assembly 30 is formed from a bobbin 31 fitted onto the outer peripheral face and a coil 32 wound around the bobbin 31, and one end part of a coil housing 33 surrounding the coil assembly 30 is joined to the outer periphery of the yoke portion 12*a* of the magnetic cylindrical body 12.

The outer periphery of the other end part of the fixed core 14 is covered with a covering layer 34, made of a synthetic resin, molded so as to connect with the other end part of the coil housing 33, and a coupler 34*a* for retaining a terminal 35 connected to the coil 32 is formed integrally with the covering layer 34 so as to project toward one side of the electromagnetic fuel injection valve 8.

Figure 3:
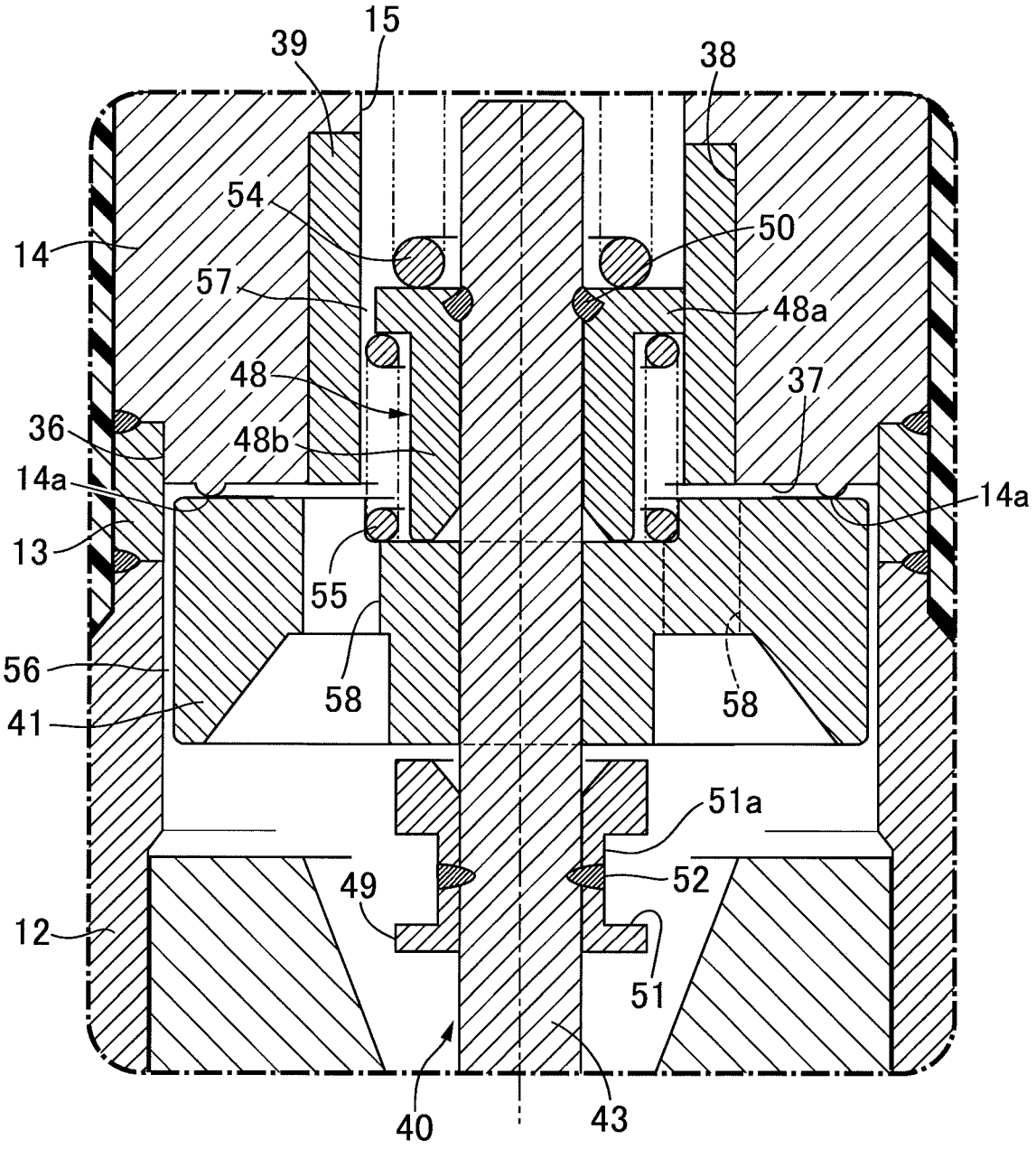
FIG. 3 is a sectional view corresponding to FIG. 2, which shows a valve-open state of the fuel injection valve.

Referring also to FIG. 3, an annular recess 36 is formed in the outer periphery of said one end part of the fixed core 14, and the other end part of the non-magnetic cylindrical body 13 is fitted into and liquid-tightly welded to the annular recess 36 so that an outer peripheral face of the other end part of the non-magnetic cylindrical body 13 is continuous with the fixed core 14.

Formed in an inner peripheral face of said one end part of the fixed core 14 is a fitting recess 38 opening on an attracting face 37 at one end of the fixed core 14, and fixedly provided in the fitting recess 38 by press fitting is a cylindrical guide bush 39 so that one end part of the guide bush 39 is flush or substantially flush with the attracting face 37 of the fixed core 14, an inner peripheral face of the guide bush 39 being continuous with the inner peripheral face of the fixed core 14.

One part of a valve body 40 and a movable core 41 are housed within the valve housing 9 from the valve seat member 11 to the non-magnetic cylindrical body 13. The valve body 40 is formed by providing a rod 43 so as to be connected to a valve part 42 opening and closing the fuel discharge hole 28 in cooperation with the valve seat 27, the rod 43 extending to the interior of the guide bush 39. The valve part 42 is formed into a spherical shape so as to be in sliding contact within the valve seat member 11, and the rod 43 is formed so as to have a smaller diameter than that of the valve part 42. An annular fuel flow path 44 is defined between the valve seat member 11 and the rod 43, and a plurality of flat parts 45 are formed on an outer peripheral face of the valve part 42 so as to form a fuel flow path between themselves and the valve seat member 11. Therefore, the valve seat member 11 allows fuel to pass therethrough while guiding opening and closing of the valve body 40.

The movable core 41 is slidably fitted onto the rod 43, the movable core 41 being disposed so as to oppose the attracting face 37 of the fixed core 14. When the coil 32 is energized, the movable core 41 is attracted toward the attracting face 37 of the fixed core 14 and abuts against a valve-open side stopper 48, the valve-open side stopper 48 being fixed to the rod 43 so that the valve body 40 is opened by the movable core 41 abutting against the valve-open side stopper 48. Moreover, a valve-closed side stopper 49 is disposed on and fixed to the rod 43 at intervals from the valve-open side stopper 48 and the fixed core 14 toward the valve seat 27 side. The sliding stroke of the movable core 41 along the rod 43 between the valve-closed side stopper 49 and the valve-open side stopper 48 is prescribed to be within a limited predetermined range.

The valve-open side stopper 48 is formed from a flange portion 48*a* slidably fitted into an inner peripheral face of the guide bush 39 and a cylindrical shaft portion 48*b* projecting from the flange portion 48*a* toward the movable core 41 side. An inner peripheral part of the flange portion 48*a* is welded to the rod 43 by means of a weld bead 50, and the valve-open side stopper 48 is disposed so that part of the shaft portion 48*b* projects further toward the movable core 41 side than the attracting face 37 and one end face of the guide bush 39 when the valve body 40 is at a valve-closed position. On the other hand, an annular groove 51 is formed in the outer periphery of the valve-closed side stopper 49, and the valve-closed side stopper 49 is fixed to the rod 43 by means of a weld bead 52 extending through a groove bottom 51*a* of the annular groove 51.

The guide bush 39 and the valve-open side stopper 48 are formed from a non-magnetic or weakly magnetic material having higher hardness than that of the fixed core 14, for example martensitic stainless steel, and have substantially equal hardness.

Referring again to FIG. 2, a pipe-shaped retainer 53 is fitted into and fixed by swaging to the hollow part 15 of the fixed core 14. A valve spring 54 is provided in a compressed state between the retainer 53 and the flange portion 48*a* of the valve-open side stopper 48, the valve spring 54 urging the valve body 40 in a direction in which the valve body 40 is seated on the valve seat 27, that is, the valve-closing direction.

Furthermore, an auxiliary spring 55 surrounding the shaft portion 48*b* of the valve-open side stopper 48 is provided in a compressed state between the flange portion 48*a* of the valve-open side stopper 48 and the movable core 41. This auxiliary spring 55 has a set load that is smaller than the set load of the valve spring 54 and exhibits a spring force that always urges the movable core 41 toward the side on which the movable core 41 moves away from the valve-open side stopper 48 and abuts against the valve-closed side stopper 49.

The other end part of the rod 43 projects from the flange portion 48*a* of the valve-open side stopper 48 and is fitted into an inner peripheral face of a movable end part of the valve spring 54, thus playing a role in positioning the valve spring 54. Moreover, the shaft portion 48*b* of the valve-open side stopper 48 is fitted into an inner peripheral face of the auxiliary spring 55 to thus play a role in positioning the auxiliary spring 55.

An annular gap 56 is ensured between the outer peripheral face of the movable core 41 and inner peripheral faces of the magnetic cylindrical body 12 and non-magnetic cylindrical body 13. A flat part 57 is provided at a plurality of locations of the outer periphery of the flange portion 48*a* of the valve-open side stopper 48, the flat parts 57 forming a fuel flow path, and a plurality of through holes 58 are provided in the movable core 41, the through holes 58 forming a fuel flow path.

In such an electromagnetic fuel injection valve 8, when the coil 32 is in a non-energized state, the valve body 40 is pushed by the set load of the valve spring 54 and is made to seat on the valve seat 27 to thus close the fuel discharge hole 28. That is, in the valve-closed state, the movable core 41 is retained in a state in which the movable core 41 is made to abut against the valve-closed side stopper 49 by the set load of the auxiliary spring 55, thus maintaining a predetermined gap from the fixed core 14.

When the coil 32 is energized in such a valve-closed state, the resulting magnetic force makes the movable core 41 be attracted to the fixed core 14 and abut against the valve-open side stopper 48 while compressing the auxiliary spring 55. That is, since at a time of initial movement, the movable core 41 slides against the set load of the auxiliary spring 55, which is smaller than that of the valve spring 54, when the movable core 41 experiences an attracting force from the fixed core 14 the movable core 41 slides smoothly and abuts against the valve-open side stopper 48 while accelerating.

When the movable core 41 abuts against the valve-open side stopper 48, the movable core 41 smoothly pushes and moves the valve-open side stopper 48 against the set load of the valve spring 54, and the movable core 41 collides with the attracting face 37 and stops. During this process, since the valve-open side stopper 48, which is pushed and moves, is fixed to the rod 43, the valve part 42 is detached from the valve seat 27, and a valve-open state is attained.

When the movable core 41 abuts against the attracting face 37 with an impact, the valve body 40, which is formed from the valve part 42 and the rod 43, overshoots due to its inertia, but since the valve-closed side stopper 49, which is integral with the valve body 40, collides with the movable core 41, the overshoot is stopped. During this process, since the valve-open side stopper 48 increases the compressive deformation of the valve spring 54 while moving away from the movable core 41 by an amount corresponding to the overshoot of the valve body 40, overshooting of the valve body 40 is also suppressed by means of the repulsive force of the valve spring 54.

When overshooting stops, the valve-open side stopper 48 is returned by means of the repulsive force of the valve spring 54 to a position at which the valve-open side stopper 48 abuts against the movable core 41, which is abutting against the attracting face 37, and the valve body 40 is retained at a predetermined valve-opening position. In this arrangement, since the set load of the auxiliary spring 55 is set smaller than the set load of the valve spring 54, which urges the valve body 40 in the valve-closing direction, when the coil 32 is energized the auxiliary spring 55 does not interfere with attraction of the movable core 41 toward the fixed core 14 and abutment of the valve-open side stopper 48 against the movable core 41 by means of the valve spring 54, and does not inhibit opening of the valve body 40 to the predetermined position.

In this way, since in the process of opening of the valve body 40, the impact force that the movable core 41 applies to the attracting face 37 can be divided into an impact force when only the movable core 41 first collides with the attracting face 37 and an impact force when the valve-closed side stopper 49 subsequently collides with the movable core 41, each of the collision energies is relatively small, and it is possible to prevent wear of the parts via which the attracting face 37 and the movable core 41 abut against each other and to suppress the collision noise to a low level. Moreover, since when the valve-closed side stopper 49 collides against the movable core 41 the valve spring 54 is deformed by a larger amount than the amount of compressive deformation when the valve opens normally, the valve spring 54 absorbs the collision energy of the valve-closed side stopper 49 against the movable core 41, thus alleviating the impact force.

When the valve body 40 opens, fuel that is fed under pressure from a fuel pump, which is not illustrated, to the fuel supply tube 16 goes in sequence through the interior of the pipe-shaped retainer 53, the hollow part 15 of the fixed core 14, the flat part 57 around the valve-open side stopper 48, the through hole 58 of the movable core 41, the interior of the valve housing 9, and the flat part 45 around the valve part 42, and is injected from the fuel discharge hole 28 directly into the combustion chamber 6 of the internal combustion engine E.

When energization of the coil 32 is subsequently cut off, since the valve-open side stopper 48 is pushed by means of the repulsive force of the valve spring 54, the valve-open side stopper 48 moves toward the valve seat 27 side together with the movable core 41 and the valve body 40, thus making the valve part 42 be seated on the valve seat 27. In this process, the movable core 41 moves with a slight delay after the valve part 42 has been seated on the valve seat 27, due to the influence of residual magnetism between the movable core 41 and the fixed core 14 and the relatively small set load of the auxiliary spring 55, which makes the movable core 41 descend forward.

When the valve body 40 is seated on the valve seat 27 for the first time, the valve body 40 rebounds due to the seating impact, but since the movable core 41, which descends after a delay, abuts against the valve-closed side stopper 49 fixed to the rebounding valve body 40, the amount of rebound of the valve body 40 can be minimized.

If rebounding of the valve body 40 is suppressed, the valve body 40 is retained in a valve-closed state by means of the repulsive force of the valve spring 54 to thus suspend fuel injection, and the movable core 41 is held in a state in which it is made to abut against the valve-closed side stopper 49 by means of the repulsive force of the auxiliary spring 55.

As described above, during the process of closing the valve body 40, since the impact force that the valve body 40 applies to the valve seat 27 can be divided into the impact force when only the valve body 40 is first seated on the valve seat 27 and the impact force when the movable core 41 subsequently collides with the valve-closed side stopper 49, each of the collision energies is relatively small. Furthermore, when the valve body 40 is seated on the valve seat 27 for the first time, it rebounds due to the seating impact and is subsequently seated on the valve seat 27 again and delivers an impact, but since the valve-closing stroke after the rebound of the valve body 40 is much smaller than the valve-closing stroke from the usual valve-open position of the valve body 40, the impact force acting on the valve seat 27 is very small. This enables wear of the parts where the valve part 42 and the valve seat 27 seat against each other to be prevented and the seating noise to be suppressed.

In the fuel injection valve 8 explained above, a characteristic structure as shown below is further added. The characteristic structure is now explained, referring also to FIGS. 4A and 4B.

Figure 4A:
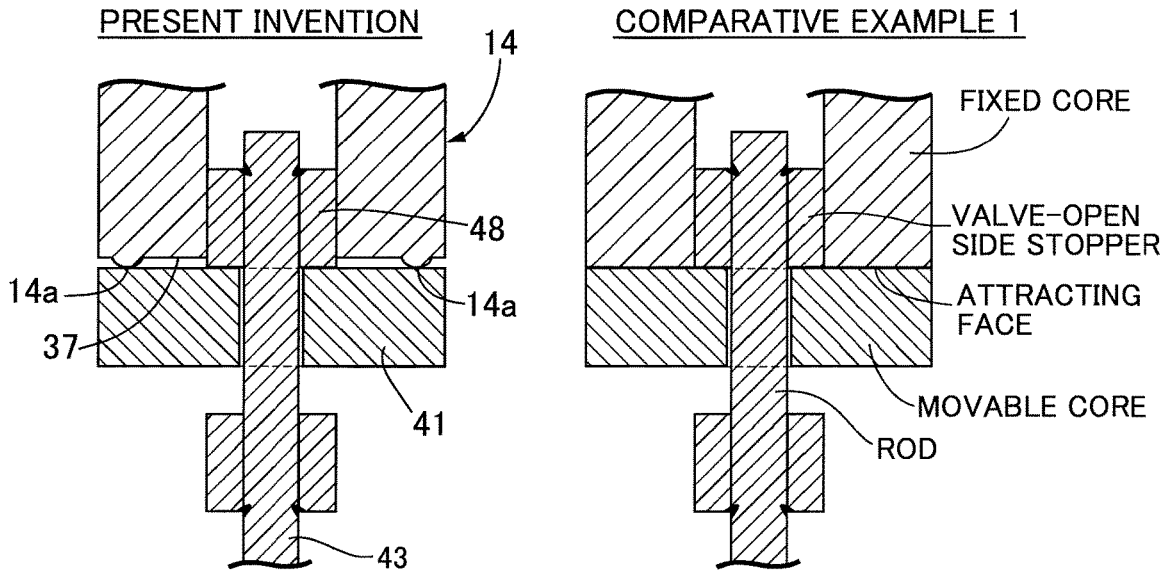
FIG. 4A shows comparative explanatory views simply showing a difference in an effect due to presence or absence of a first curved face part.
Figure 4B:
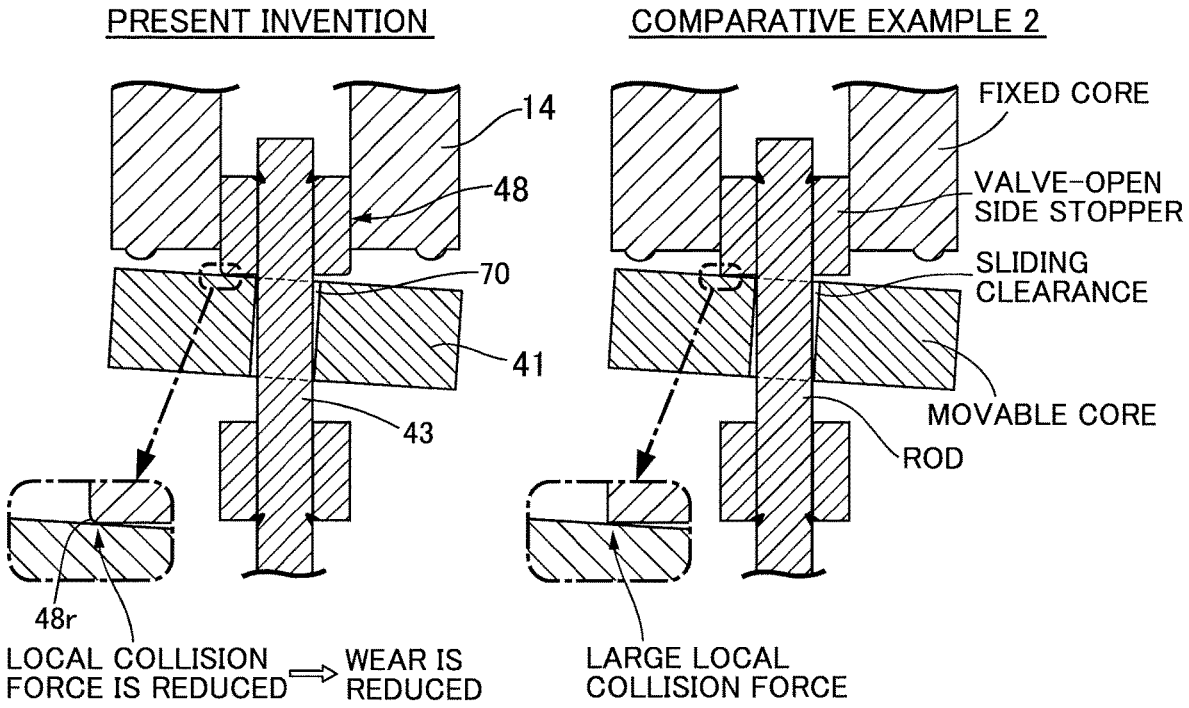
FIG. 4B shows comparative explanatory views simply showing a difference in an effect due to presence or absence of a second curved face part.

First, the view on the left side in each of FIGS. 4A and 4B shows an essential part of the first embodiment. That is, a first curved face part 14*a* is protruded integrally from a surface, opposing the movable core 41, (that is, the attracting face 37) of the fixed core 14, the first curved face part 14*a* having an arcuate cross-section and being capable of abutting against a flat upper surface of the movable core 41. In the present embodiment, the first curved face part 14*a* is formed of an annular projecting portion having an arcuate cross-section and concentrically surrounding the rod 43. Accordingly, since in a valve-open state, the movable core 41 locally abuts against (more specifically, comes into line contact with) the attracting face 37 of the fixed core 14 at the first curved face part 14*a*, it is possible to effectively reduce an influence of residual magnetism on the movable core 41 in a valve-closing process.

Note that the first curved face part 14*a* may also be formed of a plurality of hemispherical projecting portions that are protruded from the attracting face 37 at intervals in the peripheral direction thereof, and in that case, in the valve-open state, the movable core 41 comes into point contact with the attracting face 37 of the fixed core 14 at the first curved face part 14*a*. Alternatively, the first curved face part 14*a* may also be formed of a plurality of arcuate projecting portions that are protruded from the attracting face 37 and extend in the peripheral direction thereof.

An outer peripheral part of a surface, opposing the movable core 41, of the valve-open side stopper 48 is chamfered so as to have an arcuate shape in cross-section, and the chamfered portion forms a second curved face part 48*r* that can abut against the movable core 41.

The operation of the first embodiment is now explained, referring mainly to FIGS. 2 to 4B.

According to the first embodiment described above, the first curved face part 14*a* having the arcuate cross-section and capable of abutting against the movable core 41 is protruded from the surface, opposing the movable core 41, (that is, the attracting face 37) of the fixed core 14. Therefore, since in the valve-open state, the surface, opposing the fixed core 14, of the movable core 41 abuts locally at the first curved face part 14*a* against the fixed core 14 (see the view on the left side in FIG. 4A), it is possible to effectively reduce the influence of residual magnetism on the movable core 41 in the valve-closing process. Accordingly, when energization of the coil 32 is cut off and an electromagnetic attraction force thus disappears, the movable core 41 can move away from the fixed core 14 smoothly without being influenced by the residual magnetism, thereby enabling contribution to improvement of valve-closing responsiveness, and consequently enhancement of combustion efficiency of the internal combustion engine.

On the other hand, in a comparative example 1 shown in the view on the right side in FIG. 4A, since no first curved face part 14*a* is protruded from the attracting face 37 of the fixed core 14, in the valve-open state the movable core 41 is brought into surface contact with the attracting face 37 over a wide range. Therefore, when energization of the coil 32 is cut off, the movable core 41 is easily influenced by the residual magnetism so that the movable core 41 cannot move promptly away from the fixed core 14, and thus, there is a possibility of relatively deteriorating the valve-closing responsiveness.

A sliding clearance 70 is present between fitting surfaces of the movable core 41 and the rod 43. Therefore, in the valve-opening process, the movable core 41 may slide on the rod 43 while inclining more or less due to the sliding clearance 70 and then collide with the valve-open side stopper 48, and one example of such a collision mode is shown in FIG. 4B. Note that in FIGS. 4A and 4B, the sliding clearance 70 is exaggerated (also exaggerated in FIGS. 5A and 5B described later), but the actual sliding clearance 70 is set at a size of about 20 μm or less, for example.

Moreover, the second curved face part 48*r* having the arcuate cross-section and capable of abutting against the movable core 41 is provided in the outer peripheral part of the surface, opposing the movable core 41, of the valve-open side stopper 48 of the present embodiment, and therefore, as is clear from the view on the left side in FIG. 4B, a portion of the valve-open side stopper 48 with which the movable core 41 collides is the second curved face part 48*r* in the outer peripheral part of the valve-open side stopper 48. Accordingly, it is possible to effectively prevent early wear and damage of the movable core 41 due to the collision load being concentrated on one point of the valve-open side stopper 48, and thus, even if an attracting force to the movable core 41 is increased in order to increase a pressure of fuel, it is possible to contribute to improving durability of the movable core 41.

On the other hand, in a comparative example 2 shown in the view on the right side in FIG. 4B, no second curved face part 48*r* is provided in the outer peripheral part of the surface, opposing the movable core 41, of the valve-open side stopper 48, and therefore, in the valve-opening process, the above-described collision load is concentrated on edge-shaped one point of the outer peripheral part of the valve-open side stopper 48, so that the movable core 41 may be early worn and damaged. Moreover, such a problem may prominently arise, particularly in a case of increasing an attraction force with respect to the movable core 41 in order to increase a pressure of fuel.

Figure 5A:
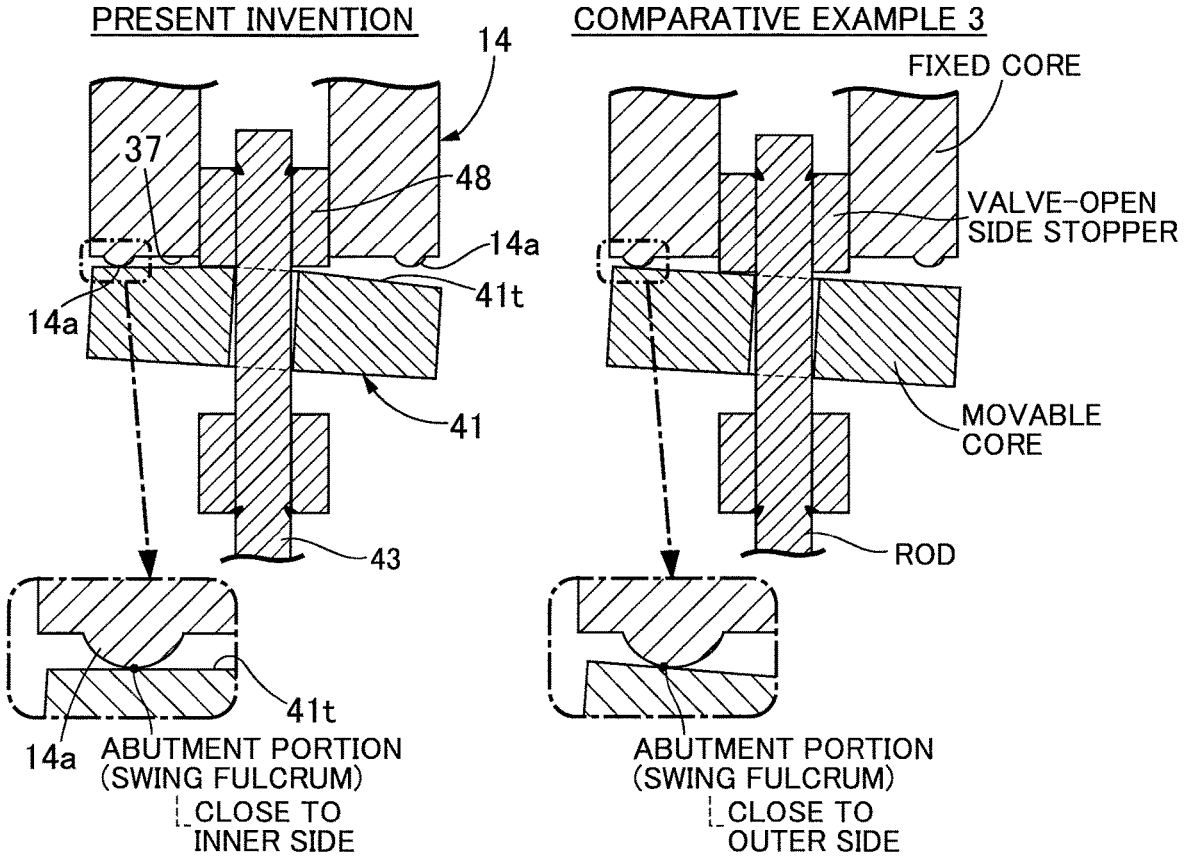
FIG. 5A shows comparative explanatory views simply showing a difference in an effect due to presence or absence of a taper face in a surface, opposing a fixed core, of a movable core, and particularly the view on a left side in FIG. 5A shows an essential part of a second embodiment.

Furthermore, in the view on the left side in FIG. 5A, a second embodiment of the present invention is illustrated.

That is, in the second embodiment, a surface, opposing a fixed core 14, of a movable core 41 is formed as a taper face 41*t* having a diameter thereof increased in going away from the fixed core 14. Since the configuration of the second embodiment is otherwise the same as that of the first embodiment, components that correspond to those of the first embodiment are only denoted by the same reference numerals and symbols, and detailed explanation thereof is omitted. Thus, the second embodiment can also attain basically the same effect as that of the first embodiment.

Furthermore, according to the second embodiment, when in the valve-opening process, the movable core 41 slides on a rod 43 while inclining more or less due to a sliding clearance 70 and then abuts against the fixed core 14, the taper face 41*t* of the movable core 41 abuts against a portion, relatively close to an inner side (that is, the rod 43 side), of a first curved face part 14*a* of the fixed core 14, as is clear from the view on the left side in FIG. 5A. Therefore, since it is possible to make relatively small a swing amount of the movable core 41 with said abutment portion as a swing fulcrum, swing of the movable core 41 is apt to easily stop accordingly, thereby stabling operation of the movable core 41, and consequently enhancing valve-opening responsiveness of a fuel injection valve 8.

On the other hand, in a comparative example 3 shown in the view on the right side in FIG. 5A, the surface, opposing the fixed core 14, of the movable core 41 is a flat face (that is, not the taper face 41*t*) orthogonal to an axis of the rod 43, and therefore, when in the valve-opening process, the movable core 41 slides on the rod 43 while inclining more or less due to the sliding clearance 70 and then abuts against the fixed core 14, the above flat face of the movable core 41 abuts against a portion, relatively close to an outer side (that is, a side opposite to the rod 43), of the first curved face part 14*a* of the fixed core 14. Accordingly, a swing amount of the movable core 41 with said abutment portion as a swing fulcrum becomes relatively large, and swing of the movable core 41 is apt to hardly stop, thereby relatively deteriorating the valve-opening responsiveness.

Figure 5B:
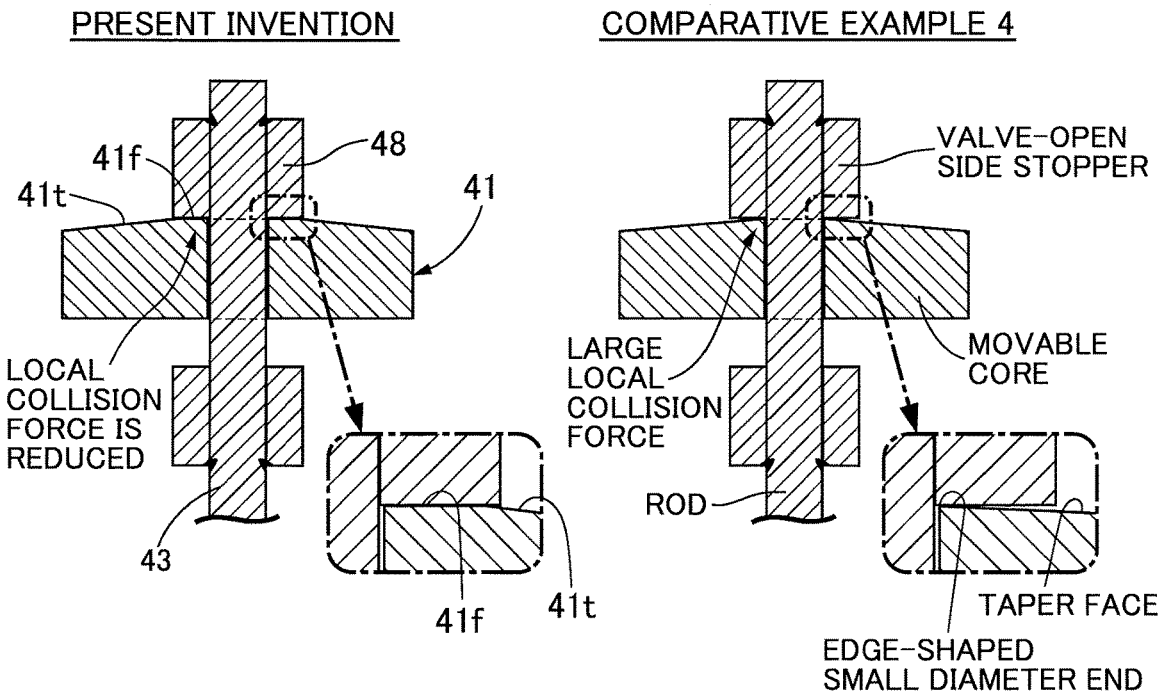
FIG. 5B shows comparative explanatory views simply showing a difference in an effect due to presence or absence of a flat face in a surface, opposing a valve-open side stopper, of the movable core, and particularly the view on a left side in FIG. 5B shows an essential part of a third embodiment.

Moreover, in the view on the left side in FIG. 5B, a third embodiment of the present invention is illustrated.

That is, in the third embodiment, although as in the second embodiment, a surface, opposing a fixed core 14, of a movable core 41 is formed as a taper face 41*t*, a middle portion (that is, a surface opposing a valve-open side stopper 48) of the movable core 41 is formed as a flat face 41*f* orthogonal to an axis of a rod 43, an outer peripheral end of the flat face 41*t* being continuous to an inner peripheral end of the taper face 41*t*. The third embodiment is different from the second embodiment only in specially providing the flat face 41*f*.

Accordingly, the third embodiment attains basically the same effect as that of the second embodiment. Furthermore, in the third embodiment, while the surface, opposing the fixed core 14, of the movable core 41 is formed as the taper face 41*t*, the middle portion (that is, the surface opposing the valve-open side stopper 48) of the movable core 41 is formed as the flat face 41*f* orthogonal to the axis of the rod 43. Therefore, when in the valve-opening process, the movable core 41 slides on the rod 43 while inclining more or less due to the sliding clearance 70 and then collides with the valve-open side stopper 48, finally the flat face 41*f* of the movable core 41 butts against the valve-open side stopper 48. Thus, it is possible to avoid a collision force acting locally on a part of the taper face 41*t*, thereby enabling wear and damage of the movable core 41 to be effectively prevented.

On the other hand, in a comparative example 4 shown in the view on the right side in FIG. 5B, the surface, opposing the fixed core 14, of the movable core 41 is formed of only a taper face (that is, no flat face), a small diameter end of the taper face having an edge shape. Therefore, when in the valve-opening process, the movable core 41 slides on the rod 43 while inclining more or less due to the sliding clearance 70 and then collides with the valve-open side stopper 48, finally the edge-shaped small diameter end of the taper face of the movable core 41 butts against the valve-open side stopper 48. Thus, a collision force locally acts on a part (that is, the edge-shaped small diameter end) of the taper face so that the movable core 41 may be worn and damaged.

Embodiments of the present invention are explained above, but the present invention is not limited to the above-mentioned embodiments and may be modified in a variety of ways as long as the modifications do not depart from the gist of the present invention.

For example, the embodiments illustrate a case in which the second curved face part 48*r* provided in the outer peripheral part of the surface, opposing the movable core 41, of the valve-open side stopper 48 is formed of a chamfered portion formed at the outer peripheral end of said opposing surface, but the second curved face part 48*r* may be formed of an annular projecting portion that has an arcuate cross-section and is protruded from the outer peripheral part of said opposing surface.

Moreover, the embodiments illustrate a case in which the guide bush 39 on which the valve-open side stopper 48 is slidably fitted and supported is formed as a member separated from the fixed core 14, and afterward is fixed (press-fitted) onto the fixed core 14. However, the guide bush 39 may be omitted, and a part (that is, the inner peripheral face) of the fixed core 14 may have a guide function for slidably guiding the valve-open side stopper 48.

What is claimed is:

1. An electromagnetic fuel injection valve, comprising:

a valve housing that has a valve seat in one end part thereof, a fixed core that is connected to another end of the valve housing and is formed with a hollow part defining a fuel flow path therein, a coil that is disposed on an outer periphery of the fixed core, a valve body that is formed by having a rod connected to a valve part that operates in cooperation with the valve seat, a movable core that is slidably fitted on to the rod while having a fixed-core-contacting face opposing an attracting face of the fixed core, a valve-open side stopper that is fixed to the rod and that, by abutting against the movable core that is attracted to the attracting face when the coil is energized, causes the valve body to undergo a valve-opening operation, a valve-closed side stopper that is fixed to the rod further on the valve seat side than the valve-open side stopper, a valve spring that urges the valve body in a valve-closing direction, and an auxiliary spring that exhibits a spring force that urges the movable core to move away from the valve-open side stopper and abut against the valve-closed side stopper when the coil is unenergized, wherein the valve-open side stopper comprises a flange portion against which the auxiliary spring abuts and which is inserted into the hollow part of the fixed core, and a cylindrical shaft portion projecting from the flange portion toward the movable core side, wherein the auxiliary spring is arranged to surround the cylindrical shaft portion, wherein the hollow part of the fixed core has an open end part which is substantially flush with the attracting face of the fixed core, wherein a first curved face part is protruded from the attracting face of the fixed core at a position intermediate between the open end part of the hollow part and a radially outer portion of the attracting face, the first curved face part having an arcuate cross-section and being capable of abutting against the movable core upon energization of the coil, wherein a second curved face part is provided in an outer peripheral part of an end surface of the shaft portion of the valve-open side stopper, the second curved face part having an arcuate cross-section and being capable of abutting against the movable core, and wherein: the movable core has a taper face at a first surface thereof opposing the fixed core, the taper face having a diameter thereof increased in going away from the fixed core, the taper face being capable of abutting against the first curved face part, and a second surface of the movable core, opposing an end face of the shaft portion of the valve-open side stopper, is formed as a flat face orthogonal to an axis of the rod.

* * * * *